US007096570B2

(12) United States Patent
Marr et al.

(10) Patent No.: US 7,096,570 B2
(45) Date of Patent: Aug. 29, 2006

(54) TUBING EXPANSION TOOL

(75) Inventors: Graeme Thomas Marr, Inverurie (GB); Mark Davies, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 479 days.

(21) Appl. No.: 10/324,420

(22) Filed: Dec. 20, 2002

(65) Prior Publication Data

US 2003/0140673 A1 Jul. 31, 2003

(30) Foreign Application Priority Data

Dec. 22, 2001 (GB) ..... 0130848.5

(51) Int. Cl.
*B23P 19/00* (2006.01)
*B21D 39/08* (2006.01)

(52) U.S. Cl. ..... 29/724; 72/58

(58) Field of Classification Search ..... 29/235, 29/724, 725; 72/58, 41, 117, 118, 122, 126; 166/387, 380; 384/93
See application file for complete search history.

(56) References Cited

U.S. PATENT DOCUMENTS

| | | | | |
|---|---|---|---|---|
| 3,693,387 | A | 9/1972 | Blackburn | 72/41 |
| 4,055,064 | A | 10/1977 | Schow | 72/118 |
| 4,102,168 | A * | 7/1978 | Brookes et al. | 72/117 |
| 4,512,669 | A * | 4/1985 | Moore | 384/93 |
| 6,425,444 | B1 | 7/2002 | Metcalfe et al. | 166/387 |
| 6,457,532 | B1 | 10/2002 | Simpson | 166/380 |

FOREIGN PATENT DOCUMENTS

| | | |
|---|---|---|
| DE | 746535 | 8/1944 |
| EP | 0 887 126 | 12/1998 |
| RU | 2060082 C1 | 5/1996 |

* cited by examiner

*Primary Examiner*—John C. Hong
(74) *Attorney, Agent, or Firm*—Patterson & Sheridan, LLP

(57) ABSTRACT

In an embodiment of the invention, there is disclosed a tubing expansion tool (300) comprising a body (302) adapted for rotation within tubing to be expanded, and three expansion member modules (306) each comprising an expansion member (310) rotatably mounted with respect to the body (302), each expansion member module (306) being releasably coupled to the body (302) as a unit.

71 Claims, 4 Drawing Sheets

TUBING EXPANSION TOOL

FIELD OF THE INVENTION

This invention relates to tubing expansion, and in particular to a tubing expansion tool, most particularly to a tubing expansion tool for use in expanding tubing downhole.

BACKGROUND OF THE INVENTION

A recent significant development in the oil and gas exploration and production industry has been the widespread introduction of expandable bore-lining tubing. The tubing is run into a bore and then expanded to a larger diameter in sit. Expansion may be achieved by a number of techniques, including the use of cones which may be pushed or pulled through the tubing, and rotary expansion tools, such as described in applicant's WO 00\37766 and U.S. Ser. No. 09\469,690, the disclosures of which are incorporated herein by reference.

It is among the objectives of embodiments of the present invention to provide an alternative tubing expansion tool.

SUMMARY OF THE INVENTION

According to an aspect of the present invention, there is provided an expansion tool comprising:

at least one expansion member module comprising an expansion member rotatably mounted with respect to the tool, the expansion member module being releasably coupled to the body.

According to a further aspect of the present invention, there is provided a tubing expansion tool comprising:

a body adapted for rotation within tubing to be expanded; and at least one expansion member module comprising an expansion member rotatably mounted with respect to the body, the expansion member module being releasably coupled to the body as a unit.

According to a further aspect of the present invention, there is provided a tubing expansion tool comprising:

a body adapted for rotation within tubing to be expanded; and a plurality of expansion member modules each comprising an expansion member rotatably mounted on a respective spindle, each expansion member module being releaseably coupled to the body as a unit.

Thus, each expansion member module comprises a separate unit and in preferred embodiments, each unit can be quickly and easily coupled to or released from the body for maintenance or replacement of the module or parts of the module, if required. Preferably, the module can also be coupled to and released from the body without disassembly of the module itself. As rotary expansion tools experience relatively high forces during tubing expansion, and may be subject to high degrees of wear, the ability to quickly and easily replace or conduct maintenance on the expansion member modules may reduce tool downtime, improving operational efficiency. Furthermore, the modules may be easily coupled to and released from the body in the work environment, such as on a rig floor.

The modules, and most preferably the spindles, may each be coupled to the body. The spindles may be releasably coupled to the body, and may be coupled at respective first and second opposite ends. Supporting the modules at each end strengthens the modules in use. The modules may be held against radial movement relative to the body.

The modules may each be coupled to the body by at least one releaseable fixing such as a bolt, screw or pin, allowing the modules to be quickly coupled to and released from the body. Preferably, the modules are externally mounted in the body. Thus the modules may be coupled to the body from outside the tool. The modules may each be located in a recess in the body and the body may comprise a plurality of recesses, one for each module. At least one end of the module, preferably an end of the spindle, may be shaped for coupling the module to the body. The module may include a plate for coupling the spindle to the body, and may include a cylindrical spindle portion on which the expansion member is mounted.

The tool preferably further comprises a restraint for locking the modules to the body. The tool may include a restraint for each end of the module and the restraint may comprise a sleeve adapted to be coupled to the body. Preferably, the restraint locks the spindle to the body.

The expansion member may be disposed at an angle with respect to a main axis of the tool. It will be understood that the expansion member is rotatable about an expansion member axis. Accordingly, the expansion member axis may be disposed at an angle to the tool main axis such that, for example, the expansion member axis converges with the tool main axis towards a leading end of the tool. At least part of an axis of the expansion member may be at an angle with respect to the main axis of the tool. Preferably, at least part of each spindle is disposed at an angle to said main axis. Most preferably, said parts of the spindles are angled towards a leading end of the tool. In this fashion, the outer diameter of the tool defined by the expansion members decreases or tapers towards the leading end of the tool.

Additionally or alternatively, the expansion member may be skewed with respect to the main axis of the tool and may, for example, be generally helically oriented. Mounting the expansion member skewed with respect to the tool axis causes the expansion member to exert a force on the tool body tending to advance the tool body through tubing being expanded on rotation of the tool body.

Further features of the tubing expansion tool will be described in more detail below, many of which features may be provided in combination with two or more different aspects of the invention.

According to a still further aspect of the present invention there is provided a tubing expansion tool comprising:

a body adapted for rotation within tubing to be expanded; and a plurality of independently rotatable expansion members, each expansion member being mounted on a respective cantilevered spindle extending from the body.

Preferably, each spindle is coupled to the body. Each spindle may be releasably coupled to the body, to allow the spindles to be released from the body for maintenance or replacement.

Preferably, a bearing is provided between each spindle and the respective expansion member. The bearings may take any appropriate form, and may include journal bearings or roller bearings, preferably both. Roller bearings are particularly effective at reducing rotary friction, and may also be utilized to retain the expansion members on their respective spindles. The journal bearings may include one or more of needle roller bearings, roller thrust bearings and taper roller bearings.

Preferably, the tool incorporates a sealed lubrication system, with seals provided between each spindle and the respective expansion member. The provision of such a sealed lubrication system tends to minimize friction between the spindles and the expansion members and prolong bearing life. This facilitates expansion of extended sections of tubing; it may be desired to expand sections of liner in excess of 1000 feet long in open hole. With conventional rotary expansion tools, the high forces and bearing wear experienced by the tools are such that expanding an extended length of tubing may be beyond the capability of many such tools.

While cone or usage expansion tools do not generally require the provision of bearings, the high axial forces required to force a cone through tubing, the requirement to utilize hydraulic pressure to move the cone through the tubing, and the requirement to expand "bottom up", generally make such expansion methods more problematic than rotary expansion techniques. Rotary expansion tools such as those described herein are used to expand tubulars top-down, which provides ease of control and access to retrieve the tool.

Most preferably, the lubrication system includes a lubricant reservoir in communication with the bearings. The lubrication system may be adapted to communicate with a lubricant reservoir located externally of the tool. One or more lubricant transfer conduits may extend from the reservoir and through each spindle to the bearings. A conduit may extend along a central axis of each spindle and one or more branches may extend radially outwards to carry lubricant to the spindle surface. Preferably, the lubrication system is pressure compensated. This may be achieved by providing a piston, a flexible member such as a diaphragm, or the like between the system and the exterior of the tool. This provides the advantage that there is therefore little or no pressure differential across the seals, extending the life of the seals and minimizing ingress of material and egress of lubricant.

Alternatively, the lubrication system may be adapted to be pressurized such that fluid in the lubrication system is under a higher pressure than fluid outside the system. Such over pressurizing of the lubrication system promotes a positive displacement of the lubrication fluid from the system, in use, to prevent ingress of well fluids, solids or other contaminants into the lubrication system. The lubrication system may include a biased piston, for example, a spring biased piston or the like for pressurizing the lubrication system fluid above the pressure of fluid outside the system.

Preferably, each spindle reduces in diameter towards a leading end of the respective expansion member. The spindle preferably defines a stepped profile, and bearings, most preferably journal bearings, of reducing diameter may be located on the spindle. Such bearings are particularly effective at withstanding radial and axial loads. Most preferably, a roller bearing is provided at a larger diameter portion of the spindle, typically at the base of the spindle.

Preferably, the expansion members are generally conical, each having a smaller diameter leading end. The cone angle may vary, depending upon the intended application of the tool, including the degree of expansion to be achieved, the material properties of the tubing to be expanded and maximum forces and torques which may be applied to the tool. The preferred cone angle is between 15 and 40 degrees. The expansion members may have a conical or tapering leading portion and a cylindrical trailing end.

Preferably, the body is adapted for rotation in the tubing about a longitudinal axis, and the expansion members are rotatable about axes which are substantially parallel to said body axis. In alternative embodiments, the expansion member axes may be non-parallel to one another or to the body axis. For example, the expansion member may be disposed at an angle with respect to a main axis of the tool. Thus, an axis of the expansion member may be at an angle with respect to the main axis of the tool. Preferably, at least part of each spindle is disposed at an angle to said main axis. Most preferably, said parts of the spindles are angled towards a leading end of the tool. In this fashion, the outer diameter of the tool defined by the expansion members decreases or tapers towards the leading end of the tool.

Preferably, the expansion members are uniformly angularly spaced. Alternatively, the expansion members may be at irregular angular spacings with respect to the tool body, if desired.

Preferably, three expansion members are provided, most preferably at 120 degree spacings. In other embodiments, however, five expansion members, or indeed any number of expansion members, may be provided.

Preferably, the expansion members describe a fixed diameter. Alternatively, the expansion members may be adapted to describe a variable diameter, and may be independently compliant, that is the members are biased to describe a larger diameter but may be forced inwardly to describe a smaller diameter.

Preferably, the expansion members are mounted on a leading end of the body, but may alternatively be mounted intermediate of the body ends. Furthermore, in certain embodiments a portion of the body may provide radial support for the members.

Preferably, the body is adapted for mounting to a support, most preferably an elongate support for supporting and locating the tool downhole.

The invention also relates to a method of expanding tubing utilizing the expansion tool of the present invention.

According to a yet further aspect of the present invention there is provided a rotary tubing expansion tool comprising:

a body adapted for rotation within tubing to be expanded;

a plurality of rotatable expansion members mounted on the body;

bearings between the expansion members and the body; and a sealed lubrication system for containing lubricant to facilitate rotation of the expansion members relative to the body.

The expansion members may be mounted on spindles or axles, and the spindles may be fixed or rotatable relative to the body. The spindles may be cantilevered relative to the body, or may be supported at both ends.

Preferably, the lubrication system is pressure compensated.

According to another aspect of the present invention, there is provided a tubing expansion tool comprising:

a body adapted for rotation within tubing to be expanded; and a plurality of independently rotatable expansion members, each expansion member being mounted on a respective spindle pivotably coupled to the body.

According to another aspect of the present invention, there is provided a method for expanding tubing comprising:

locating a tubing expansion tool within a tubing to be expanded, wherein said tool has at least one expansion member module comprising an expansion member rotatably mounted with respect to the tool, the expansion member module being releasably coupled to the body; and expanding the tubing.

According to another aspect of the present invention, there is provided a method of expanding tubing downhole, the method comprising mounting the tool described herein to a support;

running the tool into tubing to be expanded; and rotating the tool and axially translating the tool within the tubing.

According to another aspect of the present invention, there is provided a method of coupling an expansion member to a body of a tubing expansion tool, the method comprising the steps of:

providing the expansion member as part of an expansion member module; and coupling the expansion member module to the body of the tool as a unit such that the expansion member is rotatable with respect to the body.

According to another aspect of the present invention, there is provided a method of releasing an expansion member from a body of a tubing expansion tool, the method comprising the steps of:

releasing an expansion member module coupled as a unit to the body of the tool, whereby the expansion member is provided as part of the module and is rotatable with respect to the body.

DETAILED DESCRIPTION OF THE PRESENT INVENTION

Figure 1:
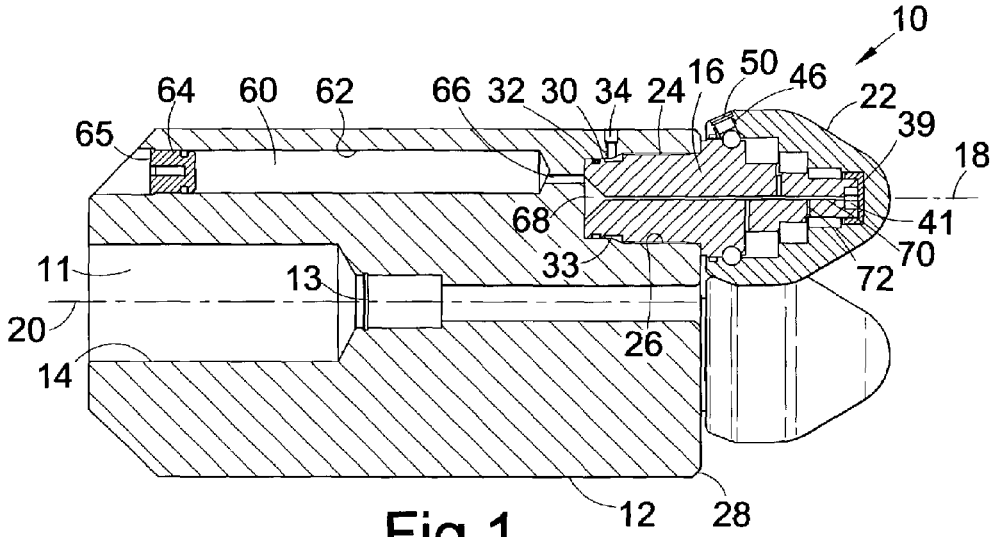
FIG. 1 is a sectional view of an expansion tool according to a first embodiment of the present invention.

Reference is first made to FIG. 1 of the drawings, which shows a sectional view of an expansion tool according to a first embodiment of the present invention. The tool 10 comprises a generally cylindrical body 12 (in this example, 197.10 mm outer diameter), the trailing end of the body 12 defining a box connection 14 for coupling to a corresponding pin connection provided on the lower end of a string of drill pipe (not shown). The body 12 defines a throughbore 11, to allow fluid to be passed through the tool 10, the throughbore 11 including a recess 13 to accommodate a flow-restricting nozzle if required.

Figure 2:
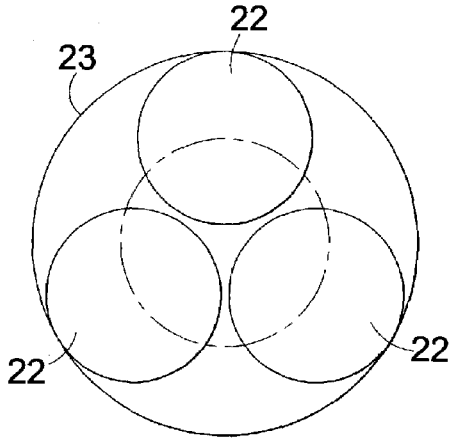
FIG. 2 is an end view of the tool of FIG. 1, showing the diameters described by the expansion members.
Figure 3:
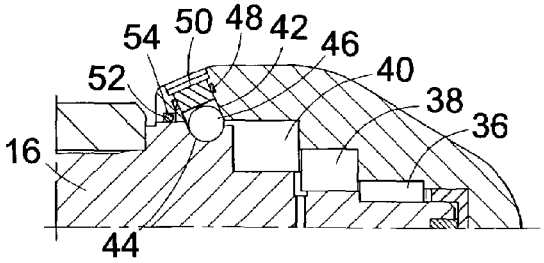
FIG. 3 is an enlarged sectional view showing details of the bearing arrangement between an expansion member and a spindle of the tool of FIG. 1.

Mounted on the leading end of the body 12 are three spindles 16 (only one shown), the spindle axes 18 lying parallel to the main body axis 20. Each spindle 16 provides mounting for a respective expansion member in the form of a 30 degree conical profile 22. In this example the profiles 22 describe a maximum diameter 23 of 220 mm, as illustrated in FIG. 2. The spindles 16 are essentially identical to one another and thus only the spindle 16 illustrated in section in FIGS. 1 and 3 of the drawings will be described in detail.

The spindle 16 has a male threaded portion 24 which is received in a complementary female threaded bore 26 in the body end face 28. The end of the spindle threaded portion also features a groove 30 housing an O-ring seal 32, and an annular slot 33 for cooperation with a pin 34 which serves to further secure the spindle 20 to the body 12. The leading end of the spindle, as illustrated in greater detail in FIG. 3 of the drawings, has a stepped profile and cooperates with a number of bearings to provide mounting for the conical profile 22. Three journal bearings 36, 38, 40 are provided between the spindle 16 and the profile 22, which is stepped internally in a corresponding manner, as may be seen from FIG. 3 of the drawings. In particular, the bearings comprise a needle roller bearing 36, a roller thrust bearing 38, and a taper roller bearing 40. The free end of the spindle 16 is capped by a brass thrust cap 39 which sits upon a hexagonal wear insert 41 located in a corresponding recess in the end face of the spindle, and which insert wears preferentially to the spindle. Furthermore, each of the spindle 16 and the profile 22 define a respective bearing race 42, 44, into which an appropriate number of balls 46 are located via a port 48 in the profile 22, and which port 48 may be closed by a plug 50 held in position by a circlip.

The base of the profile 22 defines a groove 52 accommodating an O-ring seal 54 which serves to retain lubricant in the bearing area and also to prevent ingress of material. Lubricant for the bearings is retained within a sealed pressure-compensated system including a lubricant reservoir 60, one reservoir 60 being provided for each profile 22. The reservoir 60 is provided by the leading end of a longitudinally extending bore 62 which has been drilled from the trailing end of the body 12, a piston 64 being movable within the bore 62 in response to external fluid pressure, and the piston being retained in the bore 62 by an circlip 65. A conduit 66 extends from the reservoir 60 to the base of the spindle 16. A conical recess 68 in the base of the spindle 16 in communication with the conduit 66 leads to a bore 70 extending along the spindle axis 18, with branches 72 extending radially from the bore 70 to carry lubricant to the base of the journal bearing seats.

One face of the piston 64 is exposed to external pressure, while the other face of the piston is in contact with the lubricant in the reservoir. Thus, the piston 64 may move in the bore 62 to compensate for changes in external pressure, in particular the increasing pressure experienced as the tool 10 is lowered into a bore. This minimizes the pressure differentials experienced by the seals 54, thus increasing seal life.

In use, the tool 10 is mounted to the lower end of a string of drill pipe and run into a bore. The tool 10 may be run into the bore together with a tubular to be expanded, or may be run into a tubular which has been previously located in the bore. The leading end of the profiles 22 are located in the upper end of the tubular, while the tool 10 is rotated and axial force is applied to the tool 10. As the tool 10 rotates, the profiles 22 are rolled around the inner face of the tubular, and tend to reduce the wall thickness of the tubular such that the diameter of the tubular increases. As the tool 10 translates axially, the tubular is expanded to a diameter similar to the maximum diameter described by the profiles 22.

The rotary expansion of downhole tubulars, and in particular solid walled tubulars, subjects expansion tools to significant radial, axial and torsional loads. Furthermore, the expansion of the tubing tends to produce elevated temperatures, both in the tubing and the expansion tool. The provision of the combination of journal and roller bearings within a sealed lubrication system facilitates the free rolling motion necessary to achieve the desired uniform tubular expansion while minimizing induced torque and friction, and hence increased temperature. The tool construction provides a compact and robust arrangement well adapted to withstand the loads experienced in use, and the provision of a pressure-compensated bearing lubrication system reduces the pressure differential across the bearing seals and thus extends seal life. This increases bearing life and thus facilitates use of the tool 10 in the expansion of extended lengths of tubing downhole.

In addition, those of skill in the art will appreciate that the present tool configuration combines the robustness and uniform expansion of fixed geometry expansion devices with the advantages of the reduced torques and loads required for operation of a rotary expansion device.

Figure 4:
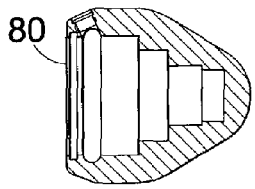
FIG. 4 is a sectional view of an alternative expansion member for the tool of FIG. 1.
Figure 5:
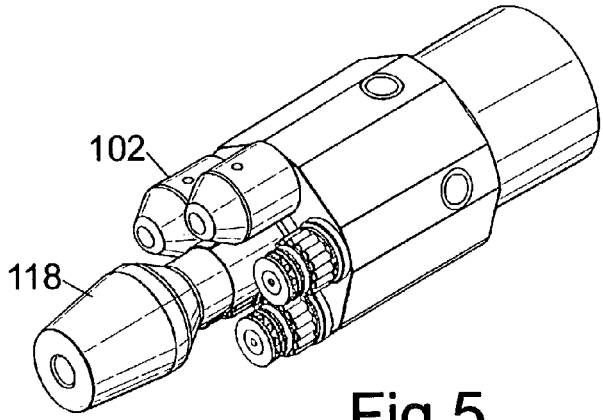
FIG. 5 is a perspective view of an expansion tool according to a second embodiment of the present invention, with three of the five expansion members removed.
Figure 6:
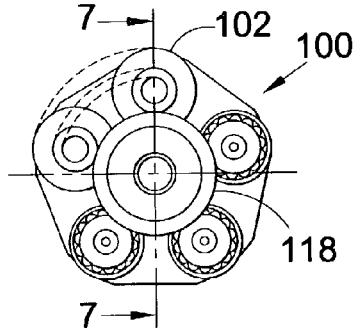
FIG. 6 is a front view of the tool of FIG. 5.
Figure 7:
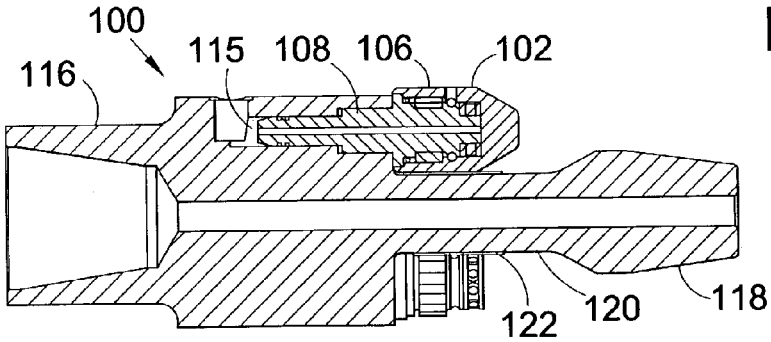
FIG. 7 is a sectional view on line 7—7 of FIG. 6.
Figure 8:
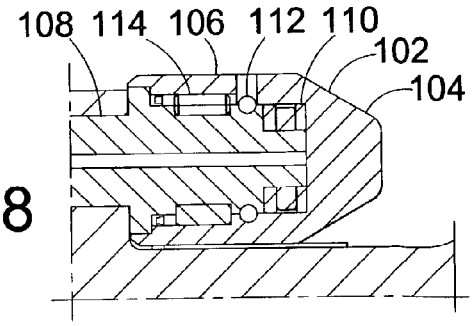
FIG. 8 is an enlarged view of a portion of FIG. 7.

The above embodiment features 30 degree angle profiles, however FIG. 4 of the drawings illustrates a profile 80 with a 20 degree angle, which will tend to induce a more gradual expansion.

Reference is now made to FIGS. 5, 6, 7 and 8 of the drawings, which illustrate an expansion tool 100 in accordance with a second embodiment of the present invention. The tool 100 includes five expansion members 102, each including a tapering leading end portion 104 and a cylindrical trailing portion 106. The spindles 108 on which the members 102 are mounted are each profiled to accommodate a thrust bearing 110, a roller bearing 112 and a journal bearing 114. Although the seals are not illustrated, the tool 100 incorporates a sealed lubrication system, including a lubrication reservoir 115.

The tool body 116 has a central portion which extends beyond the expansion members 102 and terminates in a pin connection 118 for coupling to a further part of a tool string. Rearwardly of the connection 118 is a cylindrical body portion 120 about which is mounted a contact sleeve 122 of low friction material such as PTFE. The sleeve 122 is in contact with the cylindrical portions 106 of the expansion members, and thus provides radial support for the members 102.

The tool 100 is operated in substantially the same manner as the tool 10 described above, but of course does not form the end of the tool string; other tools and devices will be mounted forwardly of the tool 100, and which may include other expansion tools.

Figure 9:
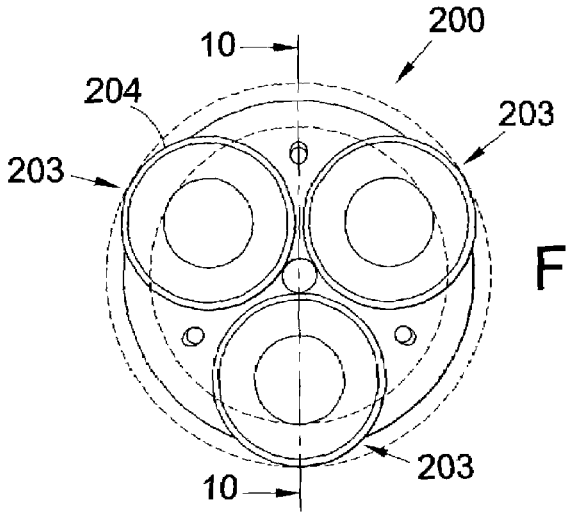
FIG. 9 is an end view of an expansion tool according to a third embodiment of the present invention.
Figure 10:
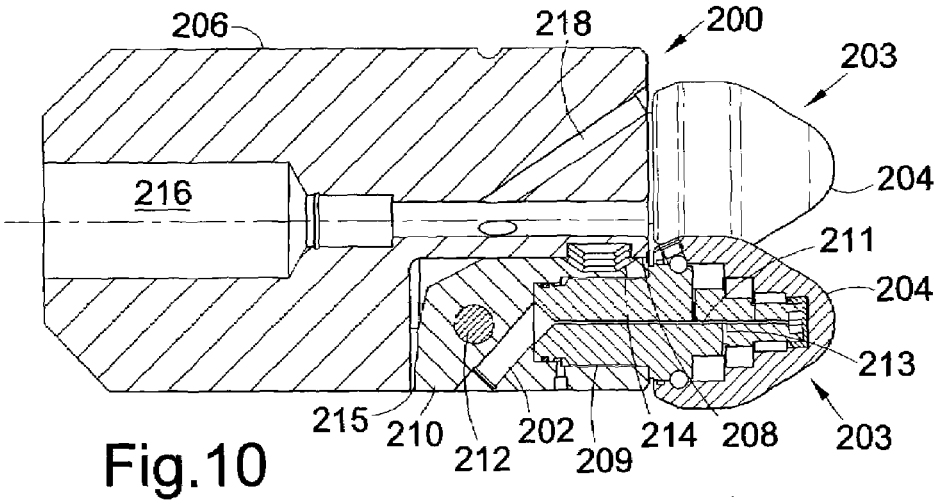
FIG. 10 is a sectional view on line 10—10 of FIG. 9.
Figure 11:
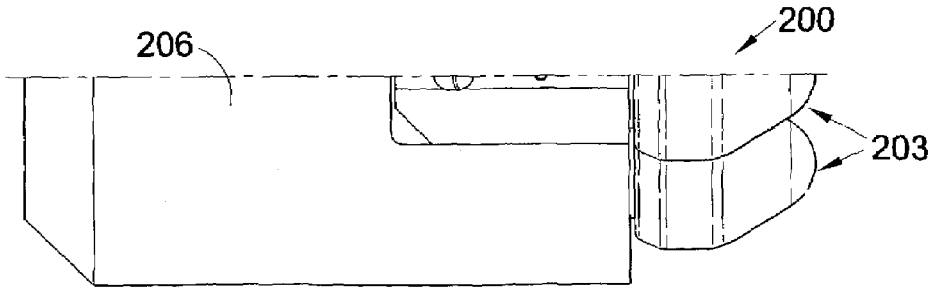
FIG. 11 is a side view showing one half of the tool of FIG. 9.
Figure 12:
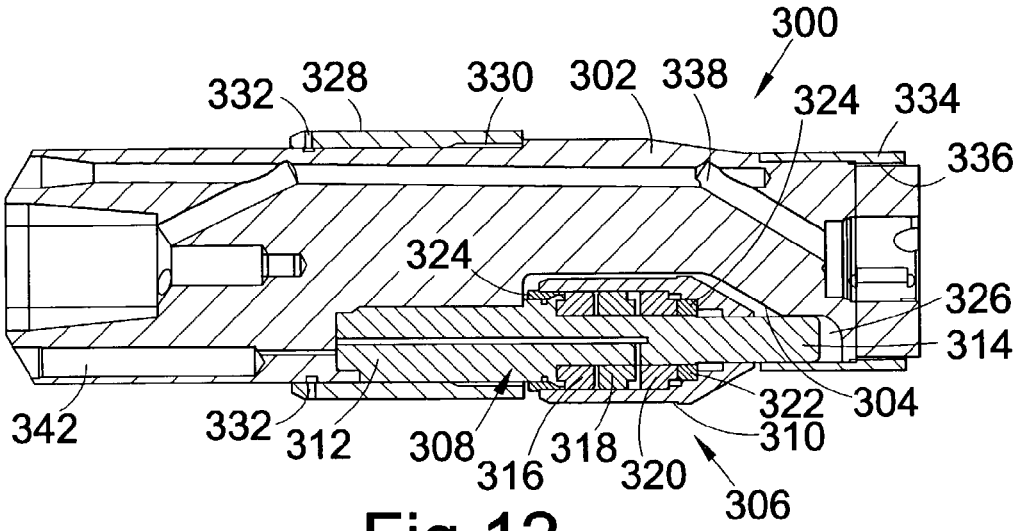
FIG. 12 is a sectional view of an expansion tool according to a fourth, preferred embodiment of the present invention.

Reference is now made to FIGS. 9, 10 and 11, which show an expansion tool 200 in accordance with a third embodiment of the present invention. The tool 200 shares many features with the tool 10 described above, including a sealed lubrication system having a lubricant reservoir 202 featuring a pressure-compensating piston (not shown). However, the tool 200 includes three tubing expansion modules 203 mounted in the tool body 206. Each module 203 includes a spindle 209 and an expansion member in the form of a conical profile or cone 204. As will be described below, providing an expansion tool with tubing expansion modules allows for quick replacement of any one of the modules in the operational environment.

Also, unlike the fixed diameter tools 10, 100, this tool 200 is compliant, in that the modules 203 including the rotary expansion profiles or cones 204 are mounted to the tool body 206 such that the cones 204 may be individually moved radially inwardly to a limited extent to describe a smaller diameter. This is useful to accommodate, for example, incompressible bore restrictions which prevent the tubing being expanded to a preferred diameter, or variations in tubing wall thickness.

The tool 200 is illustrated with the cones 204 in the minimum gauge position, hard against respective stops 208 on the body 206. The cones 204 are each mounted to the spindle 209 which is threaded and pinned in a housing 210, each housing 210 being pivotally mounted to the body 206, via respective pins 212. The pins 212 thus couple the modules 203 to the body 206 and allow, the modules to be released from the body, if required. The clearance between the sides of each housing 210 and the slots in the body 206 which accommodate the housings 210 is minimized to ensure that the pins 212 experience only shear, and not bending forces. The degree of compliancy is provided by locating a spring, in this example a stack of three disc springs 214, between the body 206 and each housing 210, the degree of outward rotation of the housings being limited by the provision of appropriate stops 215.

As with the other tools 10, 100, this tool 200 defines a central through bore 216 to allow passage of fluid through the tool body 206. In addition, three bores 218 branch off from the central bore 216 such that, in use, a cooling jet of liquid may be directed onto the portion of tubing undergoing expansion.

The sealed lubrication system of the tool 200, whilst similar in operation to that of the tool 10, differs in that the lubrication system is provided as an integral part of each tubing expansion module 203. In more detail, the lubrication system includes a lubrication reservoir 202 in each of the modules 203. The reservoirs 202 each comprise cylinders formed in the spindle 209 of the respective modules, with a bore 211 extending through the spindle 209 and branches 213 extending radially from the bore 211 to the bearing seats. A piston is mounted in each cylinder 202 to pressure compensate for changes in external pressure.

In variations in the structure of the tool 200, the disc springs 214 may be replaced by radially mounted or angled pistons (not shown) in the tool body 206, for urging the tubing expansion modules 203 outwardly in use, to pivot about the pins 212. The modules 203 are thus radially inwardly movable against the pistons, in use, to provide a degree of compliancy in the tool. The pistons may be urged radially outwardly on flow of fluid through the tool or supply of fluid in a closed system to the piston.

Reference is now made to FIGS. 12, 13, 14 and 15 which show an expansion tool 300 in accordance with a fourth, preferred embodiment of the present invention. The expansion tool 300 shares many features with the tool 10 described above, including a sealed lubrication system and bores for allowing the passage of cooling fluid through the tool.

Figure 13:
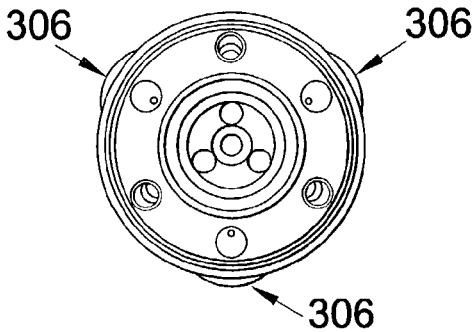
FIGS. 13 and 14 are top and bottom views of the expansion tool of FIG. 12, respectively.

In more detail, the tool 300 includes a generally cylindrical body 302 with three recesses 304 in the outer surface of the body 302, in which three corresponding tubing expansion modules 306 are mounted. The top and bottom views of FIGS. 13 and 14 show the relative location of the modules 306, which are spaced apart by 120 degrees.

Each of the modules 306 includes a spindle 308 and an expansion member in the form of a conical profile 310 rotatably mounted on the spindle 308. The profile 310 has a leading end defining a 30 degree angle. The recesses 304 in the body 302 are shaped to receive the spindles 308, which include a rear end in the form of a curved plate 312 with a cylindrical spindle shaft 314 extending from the plate 312. The plate 312 includes a number of mounting holes which receive fixing bolts (not shown) for coupling the spindle 308 to the body 302. The conical profile 310 is mounted on the cylindrical shaft 314 with a series of journal bearings 316, 318 and 320 between the conical profile 310 and the shaft 314, the bearings held axially by lock nuts 322, 324. Each module 306 includes a lubrication system similar to that described above with reference to the tool 10. A lower end 326 of the recess 304 receives the end of the shaft 314 for locating the module 306 in the body 302.

After the spindles 308 have been secured in the respective recesses 304 by the fixing bolts, a first restraint sleeve 328 is coupled to the body 302 by a co-operating threaded joint 330 and set screws 332 are located to secure the sleeve 328 against rotation. In addition, a second restraint sleeve 334 is coupled to the body 304 by a co-operating threaded joint 336, to secure the end of the cylindrical shaft 314 in the lower end 326 of the recess 304. The spindles 308 are then securely coupled to the body 302 with the conical profile 310 rotatable about the spindle ready for use in expanding tubing.

Figure 14:
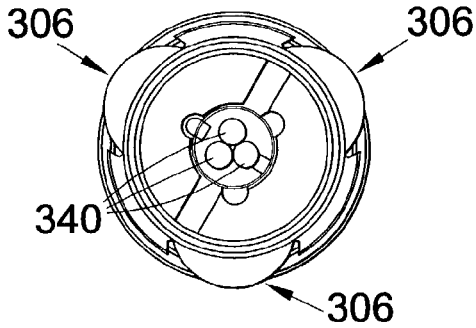
Figure 15:
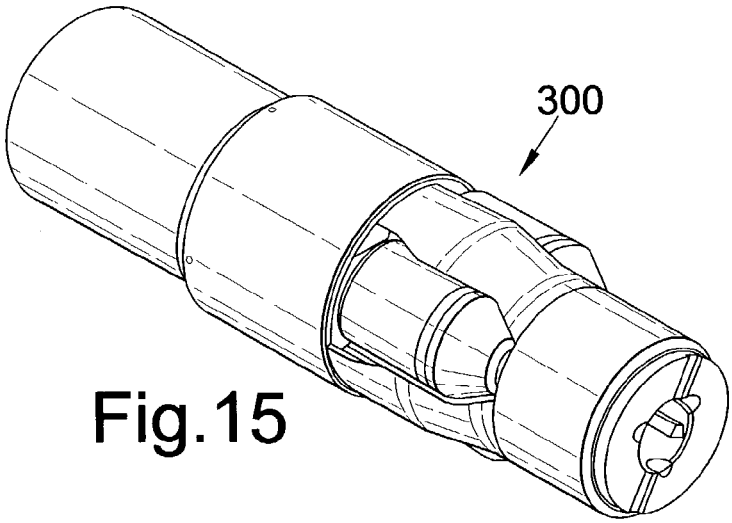
FIG. 15 is a perspective view of the expansion tool of FIG. 12.

The body 302 also includes three bores 338 which extend through the body and having outlets 340, as best shown in FIG. 14. The bores 308 allow cooling fluid to flow to the tubing during expansion.

The tool lubrication system is similar to that described with reference to the tool 10, and a conduit 342 of the lubrication system is coupled to the bearing lubrication system and pressure compensated by a piston or diaphragm.

Provision of the tool 300 including the tubing expansion modules 306 allows for quick replacement of any one of the modules 306 in the operational environment should any of the spindles 308, conical profiles 310 or the bearings 316 to 320 require replacement or maintenance. In particular, it is not required to disassemble the entire tool to remove the modules 306, nor to remove the conical profile 310 from the spindle 308 during removal. Instead, to release the modules 306, the restraint sleeves 328 and 334 are released before removing the fixing bolts connecting the spindles 308 to the body 302. The module 306 may then be removed and replaced as necessary. This both cuts down on the time and therefore operating costs of using the tool 300 and provides flexibility in use, as the procedure can be carried out in the operational environment, such as on the rig floor. Alternatively, the tool 300 may be broken-out (released) from a string carrying the tool for subsequent removal of the modules 306 in, for example, a workshop environment.

In variations in the structure of the tool 300, the tubing expansion modules 306 may be radially movably mounted (not shown) with respect to the tool body 302, to provide the tool 300 with a degree of compliancy. For example, the modules 306 may be coupled to or may define a radially movable piston, the piston urged radially outwardly, in use, on flow of fluid through the tool or supply of fluid in a closed system to the piston.

Those of skill in the art will appreciate that the above described embodiments are merely exemplary of the present invention, and that various modifications and improvements may be made thereto without departing from the scope of the invention. For example, the tubing expansion modules may be located at an angle to a main axis of the tubing expansion tool and may be angled towards a leading or lower end of the tool. The lubrication system may be provided with a lubrication fluid reservoir internally or externally of the tool and pressure compensated in any desired fashion such as by piston, diaphragm or the like. The arrangement of bearings in the tools may be any desired combination and may be tailored to the particular expansion procedure to be conducted. The spindles may be releasably coupled to the tool body using any suitable fixings such as screws, shear pins or the like. Whilst some of the above embodiments utilize cantilevered spindles, in other aspects of the invention spindles supported at both ends may be utilized.

Additionally or alternatively, the expansion member module, and thus the expansion member may be skewed with respect to the main axis of the tool and may, for example, be generally helically oriented. Thus, the expansion member axis may extend at an angle with respect to the tool main axis. Mounting the expansion member skewed with respect to the tool axis causes the expansion member to exert a force on the tool body tending to advance the tool body through tubing being expanded on rotation of the tool body.

The lubrication system may be adapted to be pressurized such that fluid in the lubrication system is under a higher pressure than fluid outside the system. Such over pressurizing of the lubrication system promotes a positive displacement of the lubrication fluid from the system, in use, to prevent ingress of well fluids, solids or other contaminants into the lubrication system. The lubrication system may include a biased piston, for example, a spring biased piston or the like for pressurizing the lubrication system fluid above the pressure of fluid outside the system.

The expansion members/modules may be at irregular angular spacings with respect to the tool body, if desired.

The invention claimed is:

1. A tubing expansion tool comprising:

a body adapted for rotation within tubing to be expanded;

at least one expansion member module comprising an expansion member rotably mounted with respect to the body, the expansion member module being releaseably coupled to the body as a unit;

a bearing between the expansion member and the body; and a sealed lubrication system for containing lubricant to facilitate rotation of the expansion member relative to the body.

2. A tubing expansion tool as claimed in claim 1, comprising a plurality of expansion member modules.

3. The tool of claim 1, wherein the module is adapted to be coupled to and released from the body without disassembly of the module itself.

4. The tool of claim 1, wherein the expansion member is rotatably mounted on a spindle.

5. The tool of claim 4, wherein the spindle is coupled to the body.

6. The tool of claim 5, wherein the spindle is coupled to the body at respective first and second opposite ends.

7. The tool of any claim 1, wherein the module is held against radial movement relative to the body.

8. The tool of any one of claim 1, wherein the module is radially movably mounted with respect to the body.

9. The tool of claim 1, wherein the module is coupled to the body by at least one releaseable fixing.

10. The tool of claim 1, wherein the module is externally mounted on the body.

11. The tool of claim 1, wherein the module is located in a recess in the body.

12. The tool of claim 11, wherein the body comprises a plurality of modules and a plurality of recesses, one for each module.

13. The tool of claim 1, wherein at least one end of the module is shaped for coupling the module to the body.

14. The tool of claim 13, wherein the expansion member is rotatably mounted on a spindle, and wherein an end of the spindle is shaped for coupling the module to the body.

15. The tool of claim 14, wherein the module includes a plate for coupling the spindle to the body.

16. The tool of claim 1, wherein the expansion member is rotatably mounted on a spindle, and wherein the spindle includes a cylindrical spindle portion on which the expansion member is mounted.

17. The tool of claim 1, further comprising a restraint for locking the module to the body.

18. The tool of claim 17, further comprising a restraint for each end of the module.

19. The tool of claim 17, wherein the restraint comprises a sleeve adapted to be coupled to the body.

20. The tool of claim 1, wherein an axis of the expansion member is disposed at an angle with respect to a main axis of the tool.

21. The tool of claim 20, wherein the expansion member is rotatably mounted on a spindle, and wherein at least part of the spindle is disposed at an angle to said main axis.

22. The tool of claim 21, wherein said part of the spindle is angled towards a leading end of the tool.

23. The tool of claim 1, wherein the expansion member is skewed with respect to a main axis of the tool.

24. The tool of claim 1, wherein the expansion member is rotatably mounted on a spindle, and wherein the spindle comprises a cantilevered spindle extending from the body.

25. The tool of claim 1, wherein the expansion member is rotatably mounted on a spindle, and wherein the spindle is releasably coupled to the body.

26. The tool of claim 1, wherein the expansion member is rotatably mounted on a spindle, and wherein the expansion member is rotatable on the spindle.

27. The tool of claim 1, wherein the expansion member is rotatably mounted on a spindle, and wherein a bearing is provided between the spindle and the expansion member.

28. The tool of claim 27, wherein a roller bearing is provided between the spindle and the expansion member.

29. The tool of claim 28, wherein the roller bearing is arranged to retain the expansion member on the spindle.

30. The tool of claim 27 wherein a journal bearing is provided between the spindle and the expansion member.

31. The tool of claim 27 wherein both a roller bearing and a journal hearing are provided between the spindle and the expansion member.

32. The tool of claim 1, wherein the expansion member is rotatably mounted on a spindle with seals provided between the spindle and the expansion member.

33. The tool of claim 32, wherein the lubrication system is provided integrally with the expansion member module.

34. The tool of claim 32, wherein the lubrication system includes a lubricant reservoir in communication with the bearing provided between the expansion member and the spindle.

35. The tool of claim 34, wherein the expansion member module includes the lubricant reservoir.

36. The tool of claim 35, wherein the spindle defines the lubricant reservoir.

37. The tool of claim 35, comprising a plurality of expansion member modules, each expansion member module including a respective lubricant reservoir.

38. The tool of claim 34 wherein lubricant transfer conduits extend from the reservoir and through the spindle to the bearing.

39. The tool of claim 38, wherein a conduit extends along a central axis of the spindle and one or more branches extend radially outwards to any lubricant to the spindle surface.

40. The tool of claim 32, wherein the lubrication :system is pressure compensated.

41. The tool of claim 40, wherein the lubrication system includes a pressure-compensating piston in fluid communication with the tool exterior.

42. The tool of claim 41, wherein the lubrication system includes a pressure-compensation diaphragm in fluid communication with the tool exterior.

43. The tool of claim 1, wherein the expansion member is rotatably mounted on a spindle, and wherein the spindle reduces in diameter towards the free end of the expansion member.

44. The tool of claim 43, wherein the spindle defines a stepped profile.

45. The tool of claim 44, wherein a bearing of reducing diameter is located on the spindle.

46. The tool of claim 44, wherein a journal bearing of -educing diameter is located on the spindle.

47. The tool of claim 45, wherein a roller bearing is provided at a larger diameter portion of the spindle.

48. The tool of claim 1, wherein the expansion member is rotatably mounted on a spindle, and wherein a roller bearing is provided at the base of the spindle.

49. The tool of claim 1, wherein the expansion member includes a conical portion.

50. The tool of claim 1, wherein the body is adapted for rotation about a longitudinal axis, and the expansion member is rotatable about an axis which is substantially parallel to said axis.

51. The tool of claim 1, comprising a plurality of expansion members uniformly angularly spaced about the body.

52. The tool of claim 1, wherein three expansion members are provided on the body.

53. The tool of claim 1, wherein three expansion members are provided on the body at 120 degree spacings.

54. The tool of claim 1, wherein more than three expansion members are provided on the body.

55. The tool of claim 1, wherein a portion of the expansion member describes a fixed diameter.

56. The tool of claim 1, wherein the expansion member describes a variable diameter.

57. The tool of claim 56, comprising a plurality of independently radially movable expansion members.

58. The tool of claim 1, wherein the expansion member is mounted on a leading end of the body.

59. The tool of claim 1, wherein the tool body Is adapted for location intermediate the ends of a tool string.

60. The tool of claim 1, wherein the body is adapted for mounting to a support.

61. The tool of claim 60, wherein the body is adapted for mounting to an elongate support for supporting and locating the tool down hole.

62. A rotary tubing expansion tool comprising:

a body adapted for rotation within tubing to be expanded;

at least one rotatable expansion member mounted on the body;

a bearing between the expansion member and the body; and a sealed lubrication system for containing lubricant to facilitate rotation of the expansion member relative to the body.

63. The tool of claim 62, wherein the lubrication system is pressure compensated.

64. The tool of claim 63, wherein the lubrication system includes a pressure-compensation diaphragm in fluid communication with the tool exterior.

65. A rotary tubing expansion tool comprising:

a body adapted for rotation within tubing to be expanded:

at least one rotatable expansion member mounted on the body;

a bearing between the expansion member and the body; and a sealed lubrication system for containing lubricant to facilitate rotation of the expansion member relative to the body, wherein the lubrication system is pressure compensated and includes a pressure-compensating piston in fluid communication with the tool exterior.

66. A rotary tubing expansion tool comprising:

a body adapted for rotation within tubing to be expanded;

at least one rotatable expansion member mounted on the body, wherein the expansion member is part of an expansion member module;

a bearing between the expansion member and the body; and a sealed lubrication system for containing lubricant to facilitate rotation of the expansion member relative to the body.

67. The tool of claim 66, wherein the expansion member module is releasably coupled to the body as a unit.

68. The tool of claim 66, wherein the module is adapted to be coupled to and released from the body without disassembly of the module itself.

69. The tool of claim 66, wherein the lubrication system is provided integrally with the expansion member module.

70. The tool of claim 66, wherein the lubrication system includes a lubricant reservoir in communication with the bearing provided between the expansion member and the spindle.

71. The tool of claim 70, wherein the spindle defines the lubricant reservoir.

* * * * *

UNITED STATES PATENT AND TRADEMARK OFFICE

CERTIFICATE OF CORRECTION

PATENT NO. : 7,096,570 B2
APPLICATION NO. : 10/324420
DATED : August 29, 2006
INVENTOR(S) : Marr et al.

It is certified that error appears in the above-identified patent and that said Letters Patent is hereby corrected as shown below:

In the Claims:

In Column 10, Claim 1, Line 39, please delete "rotably" and insert --rotatably--;

In Column 11, Claim 31, Line 50, please delete "hearing" and insert --bearing--;

In Column 12, Claim 39, Line 6, please delete "any" and insert --carry--;

In Column 12, Claim 40, Line 7, please delete ":system" and insert --system--;

In Column 12, Claim 46, Line 24, please delete "-educing" and insert --reducing--;

In Column 12, Claim 59, Line 52, please delete "Is" and insert --is--;

In Column 12, Claim 61, Line 58, please delete "down hole" and insert --downhole--.

Signed and Sealed this

Seventh Day of August, 2007

JON W. DUDAS
*Director of the United States Patent and Trademark Office*